US010676222B2

(12) United States Patent
Kim et al.

(10) Patent No.: US 10,676,222 B2
(45) Date of Patent: Jun. 9, 2020

(54) PACKING SYSTEM AND METHOD

(71) Applicant: OCI Company Ltd., Seoul (KR)

(72) Inventors: Hyun Cheol Kim, Iksan-si (KR); Shin Kim, Iksan-si (KR)

(73) Assignee: OCI Company Ltd., Seoul (KR)

( * ) Notice: Subject to any disclaimer, the term of this patent is extended or adjusted under 35 U.S.C. 154(b) by 230 days.

(21) Appl. No.: 15/742,100

(22) PCT Filed: Jul. 6, 2016

(86) PCT No.: PCT/KR2016/007321
§ 371 (c)(1),
(2) Date: Jan. 5, 2018

(87) PCT Pub. No.: WO2017/007237
PCT Pub. Date: Jan. 12, 2017

(65) Prior Publication Data

US 2018/0201398 A1 Jul. 19, 2018

(30) Foreign Application Priority Data

Jul. 6, 2016 (KR) ..... 10-2015-0096298

(51) Int. Cl.
*B65B 9/067* (2012.01)
*B65H 23/04* (2006.01)
(Continued)

(52) U.S. Cl.
CPC ..... *B65B 9/067* (2013.01); *B65B 9/22* (2013.01); *B65B 41/16* (2013.01); *B65B 49/04* (2013.01);
(Continued)

(58) Field of Classification Search
CPC ..... B65B 9/06; B65B 9/067; B65B 2009/06; B65B 2009/063; B65B 11/10; B65B 11/105
(Continued)

(56) References Cited

U.S. PATENT DOCUMENTS 3,274,746 A * 9/1966 James et al. ..... B65B 9/06 53/433
3,532,516 A * 10/1970 Erekson ..... B65B 9/06 53/450
(Continued)

FOREIGN PATENT DOCUMENTS

CN 101927841 A 12/2010
DE 102006013858 A1 10/2007
(Continued)

OTHER PUBLICATIONS

International Search Report PCT/ISA/210 for International Application No. PCT/KR2016/007321 dated Oct. 14, 2016.
(Continued)

*Primary Examiner* — Stephen F. Gerrity
(74) *Attorney, Agent, or Firm* — Harness, Dickey & Pierce, P.L.C.

(57) ABSTRACT

The present invention relates to a packing system including a transporting device, an erecting device, and a guiding device. The packing system is configured to reduce the number of packing operations and to simplify the packing process, thereby improving production efficiency, compared with a conventional system. The packing system is configured to minimize wrinkling of a packing material and to adjust position of ends of the packing material in a way that the packing material is always supplied to a predetermined
(Continued)

position, thereby reducing a failure rate of a packed product. It is possible to pack various sizes of packing target objects using a single system.

14 Claims, 9 Drawing Sheets

(51) Int. Cl.

| | |
|---|---|
| ***B65H 23/00*** | (2006.01) |
| ***B65B 59/00*** | (2006.01) |
| ***B65B 49/04*** | (2006.01) |
| ***B65B 9/22*** | (2006.01) |
| ***B65B 41/16*** | (2006.01) |
| ***B65B 57/04*** | (2006.01) |
| ***B65B 9/06*** | (2012.01) |

(52) U.S. Cl.
CPC ..... *B65B 57/04* (2013.01); *B65B 59/00* (2013.01); *B65H 23/00* (2013.01); *B65H 23/04* (2013.01); *B65B 2009/063* (2013.01); *B65H 2701/1944* (2013.01)

(58) Field of Classification Search
USPC ..... 53/450, 550
See application file for complete search history.

(56) References Cited

U.S. PATENT DOCUMENTS

| | | | | | |
|---|---|---|---|---|---|
| 3,958,390 | A * | 5/1976 | Pringle, Jr. et al. | B65B 9/06 | 53/433 |
| 4,328,655 | A * | 5/1982 | Spencer | B65B 63/026 | 53/439 |
| 4,430,844 | A * | 2/1984 | James | B65B 9/067 | 53/141 |
| 4,482,341 | A * | 11/1984 | Gram | B65B 9/073 | 493/302 |
| 4,546,595 | A * | 10/1985 | Yasumune et al. | B65B 9/067 | 53/450 |
| 5,287,681 | A * | 2/1994 | Vernon et al. | B29C 53/50 | 53/550 |
| 5,491,960 | A | 2/1996 | Taylor, Jr. | | |
| 5,799,470 | A | 9/1998 | Sautter et al. | | |
| 7,757,461 | B2 * | 7/2010 | Honegger | B65B 9/067 | 53/447 |
| 2004/0255557 | A1 * | 12/2004 | Shanklin et al. | B65B 11/54 | 53/450 |
| 2005/0262812 | A1 | 12/2005 | Thorpe | | |
| 2007/0131739 | A1 * | 6/2007 | Ponti | B65B 9/067 | 229/87.01 |
| 2010/0323868 | A1 | 12/2010 | Miyamoto et al. | | |
| 2011/0256998 | A1 | 10/2011 | Tanner | | |
| 2012/0198796 | A1 * | 8/2012 | Heuberger | B65B 9/06 | 53/473 |
| 2014/0249007 | A1 | 9/2014 | Ehrmann | | |
| 2014/0318081 | A1 * | 10/2014 | Knopfel | B68G 9/00 | 53/450 |

FOREIGN PATENT DOCUMENTS

| | | | | |
|---|---|---|---|---|
| JP | 05170210 | A * | 7/1993 | |
| JP | 11105811 | A * | 4/1999 | B65B 2009/063 |
| JP | 2006016064 | | 1/2006 | |
| KR | 2003-0072717 | | 9/2003 | |
| KR | 20-0405358 | | 1/2006 | |
| KR | 10-0965749 | | 6/2010 | |
| KR | 10-1123253 | | 3/2012 | |
| KR | 2014-0120732 | | 10/2014 | |
| KR | 2015-0075127 | | 7/2015 | |

OTHER PUBLICATIONS

Written Opinion of the International Searching Authority PCT/ISA/237 for International Application No. PCT/KR2016/007321 dated Oct. 14, 2016.

* cited by examiner

PACKING SYSTEM AND METHOD

CROSS-REFERENCE TO RELATED APPLICATIONS

This application is a national phase under 35 U.S.C. § 371 of PCT International Application No. PCT/KR2016/007321 which has an International filing date of Jul. 6, 2016, which claims priority to Korean Application No. 10-2015-0096298, filed Jul. 7, 2015, the entire contents of each of which are hereby incorporated by reference.

TECHNICAL FIELD

The present invention relates to a packing system, and in particular, to a packing system, which is configured to reduce the number of packing operations and to simplify the packing process, thereby improving production efficiency, compared with a conventional system. The system is also configured to minimize wrinkling of a packing material and to adjust position of ends of the packing material in a way that the packing material is always supplied to a predetermined position, thereby reducing a failure rate of a packed product. In addition, it is possible to pack various sizes of packing target objects using a single system.

BACKGROUND ART

A vacuum insulation panel is an insulation panel having high performance, compared with general insulation panels.

The vacuum insulation panel is composed of a thermally insulating molding body made of a conventional inorganic material and a gas-prevention film enclosing the same, and it has a vacuumed inner space of the thermally insulating molding body as the most important feature thereof. Here, the thermally insulating molding body filling an inner space of the vacuum insulation panel is called "core", and in most cases, the core is formed to have a rectangular parallelepiped shape, using a glass-fiber compressed material or a powder compressed material containing silica powder.

A process of fabricating such a vacuum insulation panel includes a process of mixing a core material, a pressing process for shaping the core, a cutting process of the shaped core, a packing process and a vacuum packing process using a packing material.

Here, if the packing material in the packing process is packed to be in contact with the core as close as possible, without wrinkle, the vacuum packing process can be smoothly executed, and this results in improvement in quality of the vacuum insulation panel.

However, when, to pack the core, the core is packed with the packing material, there is a problem of low production efficiency caused by many packing processes; for example, the packing material is firstly folded to be in close contact with a side surface of a rectangular parallelepiped core, and then, the packing material, which is in close contact with the side surface of the core, is secondly folded to be in close contact with a top surface of the core.

As prior arts, Korea Patent Publication Nos. 10-2003-0072717 and 10-2014-0120732 are found.

DISCLOSURE

Technical Problem

Accordingly, an object of the present invention is to solve such conventional problems and to provide a packing system that is configured to reduce the number of a packing process and to simplify the packing process, thereby improving production efficiency, compared with a conventional system.

In addition, the object of the present invention is to provide a packing system that is configured to minimize wrinkling of a packing material and to adjust position of ends of the packing material in a way that the packing material is always supplied to a predetermined position, thereby reducing a failure rate of a packed product.

Furthermore, the object of the present invention is to provide a packing system that can pack various sizes of packing target objects using a single system.

Technical Solution

According to the present invention, the object can be achieved by a packing system including a transporting device transporting a packing material and a packing target object provided on the packing material; an erecting device including a pair of parts, which are placed near an end of the transporting device and are spaced apart from each other, and allowing width-directional both ends of the packing material entered into the transporting device to be transported in a direction perpendicularly crossing a transportation direction of the packing material and in a standing manner; and a guiding device allowing the width-direction both ends of the packing material transported by the transporting device to become close to each other and guiding the packing material to be folded and packed toward a top surface of the packing target object.

Here, it is preferred that the guiding device is configured to include a pair of a first guide body and a second guide body, which are spaced apart from each other and face each other, the guiding device is spaced apart from the packing target object and is placed on the transporting device to be in contact with the packing material, which is erected by the erecting device and is in motion, thereby providing a space, allowing the packing material to be folded toward the top surface of the packing target object, and a space between the first guide body and the second guide body decreases in the transportation direction of the packing target object.

Here, it is preferred that the guiding device includes a structure configured to adjust a space between the pair of separate facing the first and second guide bodies depending on one or both of a size and a material of the packing target object.

Here, it is preferred that the system further includes an endpoint positioning device that presses one and opposite end portions of the packing material, which are moved toward each other during passing through the guiding device, and that allows the one and opposite end portions of the packing material to pass therethrough in a direction of the packing material transported by the transporting device.

Here, it is preferred that the endpoint positioning device includes a pair of first rollers configured to rotate in opposite directions, with the one end portion of the packing material interposed therebetween, thereby allowing the packing material to pass therethrough, a pair of second rollers configured to rotate in opposite directions, with the opposite end portion of the packing material interposed therebetween, thereby allowing the packing material to pass therethrough, and a detection part configured to sense positions of the one and opposite ends of the packing material passing through the first roller and the second roller, thereby allowing the one end or the opposite end of the packing material to be tightened or loosened by the first roller or the second roller.

Here, it is preferred that the endpoint positioning device includes a structure, in which rotation speeds of the first roller and the second roller is adjusted depending on a transportation speed of the packing target object transported by the transporting device.

Here, it is preferred that the erecting device has a triangular vertical section shape, and the packing material is in contact with an inclined surface of the erecting device.

Here, it is preferred that the inclined surface of the erecting device has an adjustable angle with respect to a horizontal plane.

Here, it is preferred that the system further includes a tension adjusting device pressing the packing material to be entered into the transporting device.

Here, it is preferred that the tension adjusting device includes one or more of a pressing-position adjusting member, which is provided in the transporting device and adjusts a pressing position of the packing material, and a direction-changing rod, which changes a direction of the packing material to be entered into the transporting device.

According to some embodiments of the inventive concept, the object can be achieved by a packing method including an input step of inputting a packing material and a packing target object placed on the packing material into a transporting device; a packing material erecting step of transporting the packing material transported by the transporting device in a direction perpendicularly crossing a transportation direction and in a standing manner, using a pair of separated erecting devices provided at an end of the transporting device; an endpoint closing step of allowing width-directional both ends of the packing material transported by the transporting device to become close to each other through a guiding device; and a packing step of folding and packing the both ends of the packing material toward a top surface of the packing target object, using the guiding device.

Here, it is preferred that the guiding device is configured to include a pair of a first guide body and a second guide body, which are spaced apart from each other and face each other, the guiding device is spaced apart from the packing target object and is placed on the transporting device to be in contact with the packing material, which is erected by the erecting device and is in motion, thereby providing a space, allowing the packing material to be folded toward the top surface of the packing target object, and a space between the first guide body and the second guide body decreases in the transportation direction of the packing target object.

Here, it is preferred that the guiding device includes a structure configured to adjust a space between the pair of separate facing the first and second guide bodies depending on one or both of a size and a material of the packing target object.

Here, it is preferred that the method may further include an endpoint positioning step of pressing one and opposite end portions of the packing material, which are moved toward each other through the endpoint closing step, using an endpoint positioning device, and of passing the one and opposite end portions of the packing material in a direction of the packing material transported by the transporting device, between the endpoint closing step and the packing step.

Here, it is preferred that the endpoint positioning device includes a pair of first rollers configured to rotate in opposite directions, with the one end portion of the packing material interposed therebetween, thereby allowing the packing material to pass therethrough, a pair of second rollers configured to rotate in opposite directions, with the opposite end portion of the packing material interposed therebetween, thereby allowing the packing material to pass therethrough, and a detection part configured to sense positions of the one and opposite ends of the packing material passing through the first roller and the second roller, thereby allowing the one end or the opposite end of the packing material to be tightened or loosened by the first roller or the second roller.

Here, it is preferred that the endpoint positioning device includes a structure, in which rotation speeds of the first roller and the second roller are adjusted depending on a transportation speed of the packing target object transported by the transporting device.

Here, it is preferred that the erecting device has a triangular vertical section shape, and the packing material is in contact with an inclined surface of the erecting device.

Here, it is preferred that the inclined surface of the erecting device has an adjustable angle with respect to a horizontal plane.

Here, it is preferred that, before the input step, the method may further include a tension adjusting step of adjusting tension of the packing material to be entered into the transporting device, using a tension adjusting device.

Here, it is preferred that the tension adjusting device includes one or both of a pressing-position adjusting member, which is provided in the transporting device and adjusts a pressing position of the packing material, or a direction-changing rod, which changes a direction of the packing material to be entered into the transporting device.

Advantageous Effects

According to the present invention, a packing system is provided to reduce the number of a packing process and to simplify the packing process, thereby improving production efficiency, compared with a conventional system.

In addition, it is possible to minimize wrinkling of a packing material and to adjust position of ends of the packing material in a way that the packing material is always supplied to a predetermined position, and thus, a failure rate of a packed product can be reduced.

Furthermore, it is possible to pack various sizes of packing target objects using a single system.

MODE FOR INVENTION

Hereinafter, a packing system according to some embodiments of the present invention will be described in detail with reference to the accompanying drawings. Here, various currently available packing materials may be used as a packing material for the present invention, but an aluminum-containing packing film is used in the present invention. Also, various objects may be used as a packing target object to be packed by such a packing material, but a case, in which a rectangular parallelepiped object (especially, a core of a vacuum insulation panel) is used as the packing target object, will be described as an example.

Figure 1:
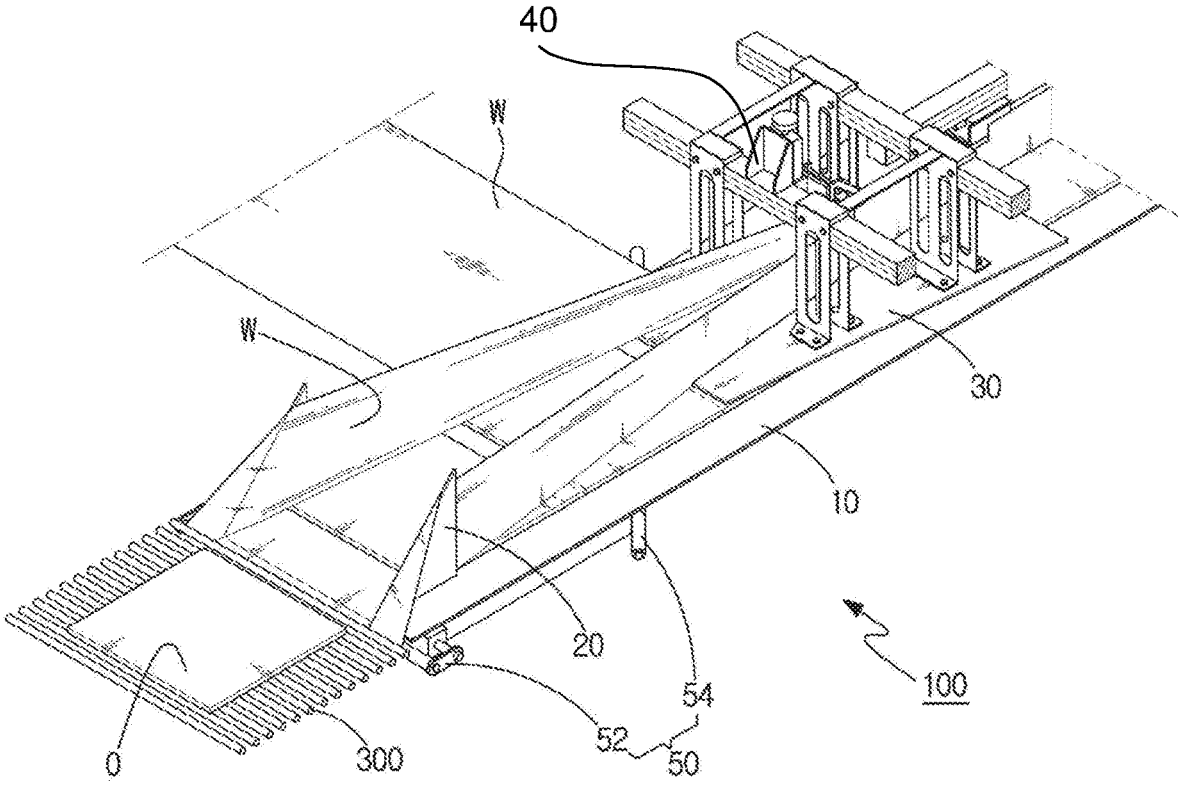
FIG. 1 is a perspective view illustrating an overall shape of a packing system according to some embodiments of the present invention.
Figure 2:
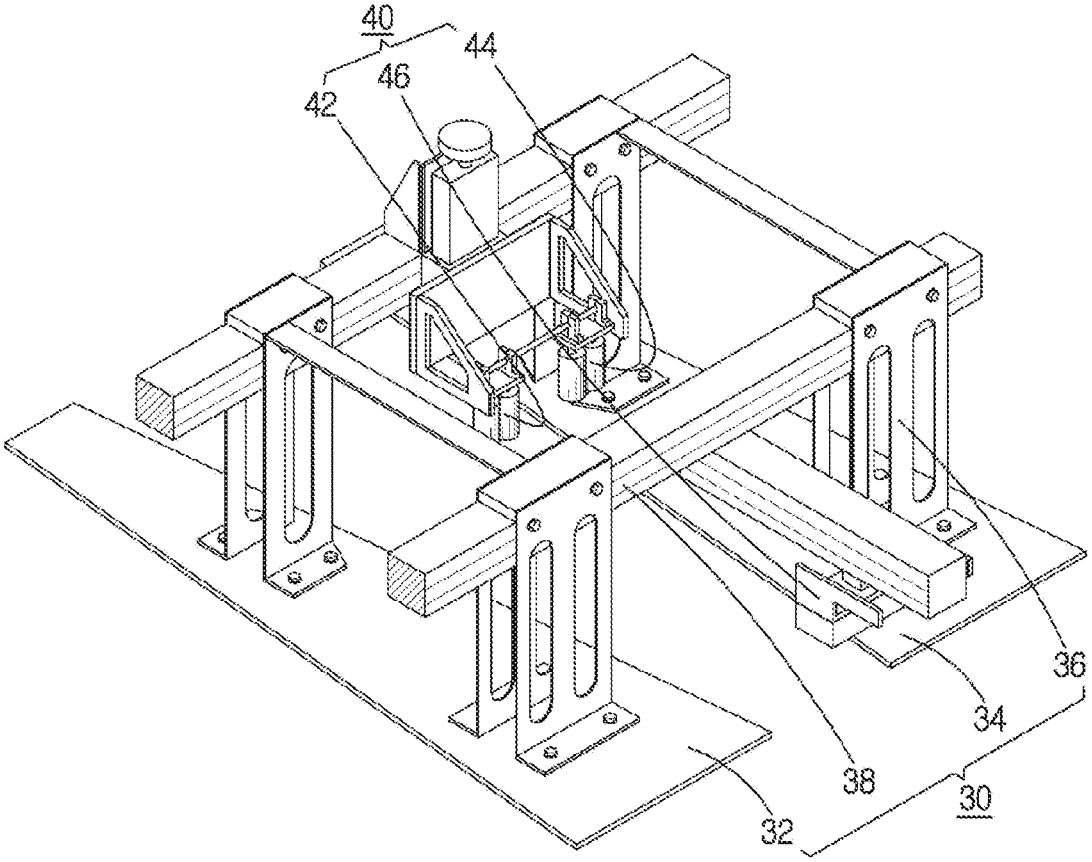
FIG. 2 is a perspective view illustrating a guiding device and an endpoint positioning device in the packing system shown in FIG. 1.
Figure 3:
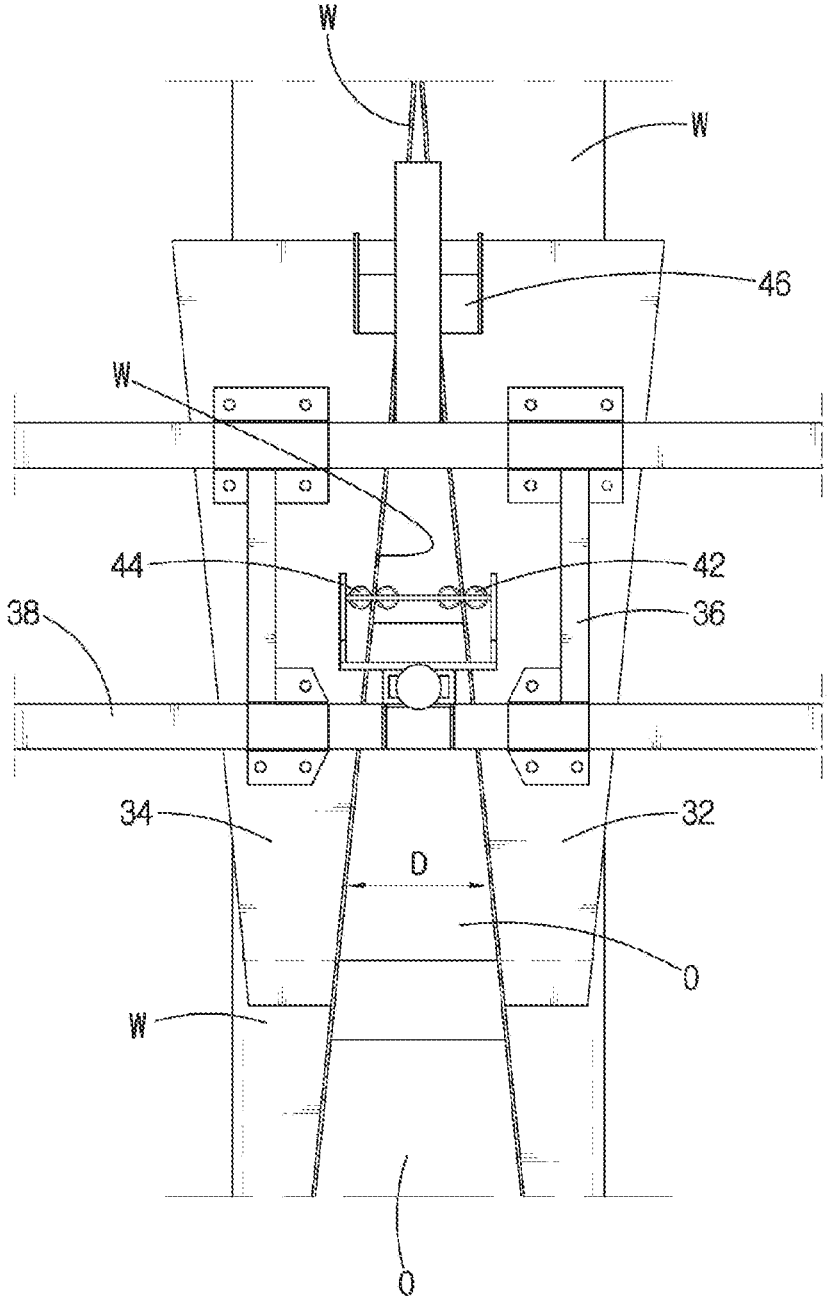
FIG. 3 is a plan view illustrating a portion, which is a part of the packing system shown in FIG. 1, and in which a guiding device and an endpoint positioning device are provided.
Figure 4:
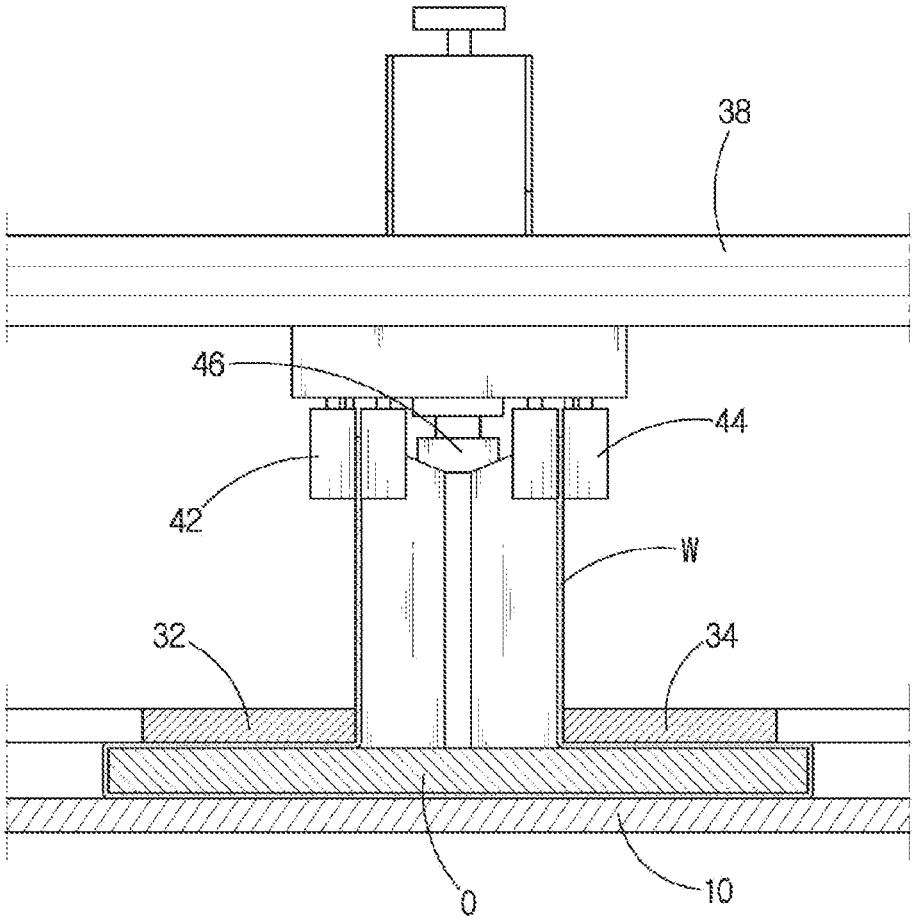
FIG. 4 is a sectional view of FIG. 3.
Figure 5:
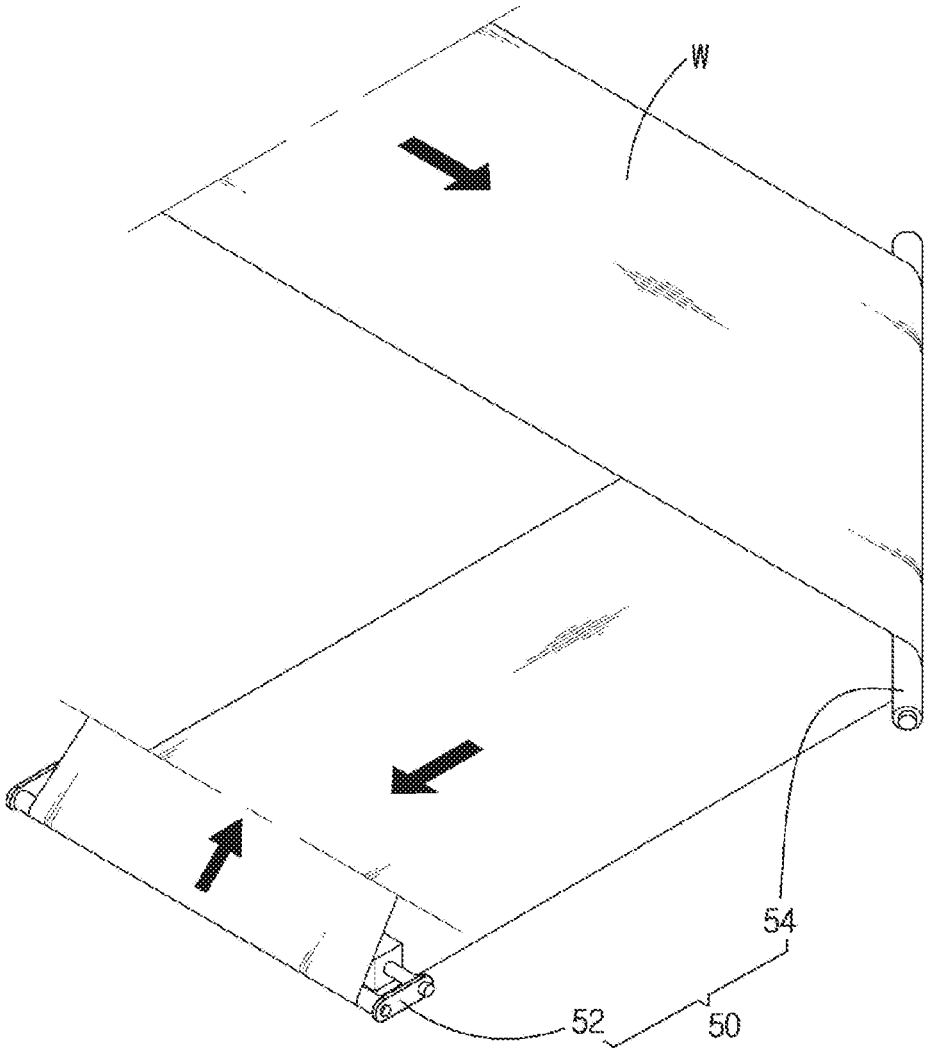
FIG. 5 is a perspective view illustrating a portion, to which a packing material is supplied, of the packing system shown in FIG. 1, FIGS. 6A, 6B and 6C are diagrams respectively illustrating an example of an erecting device according to the present invention.
Figure 6A:
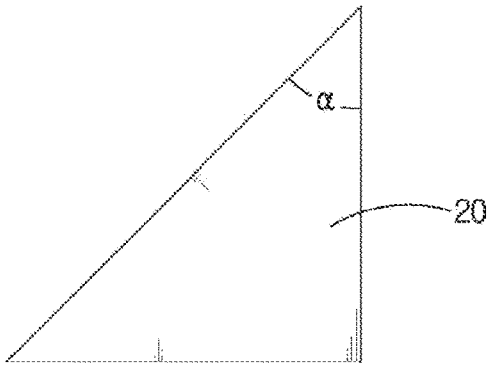
Figure 6B:
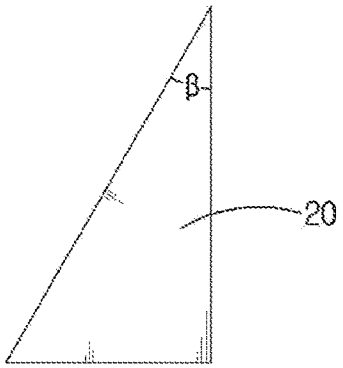
Figure 6C:
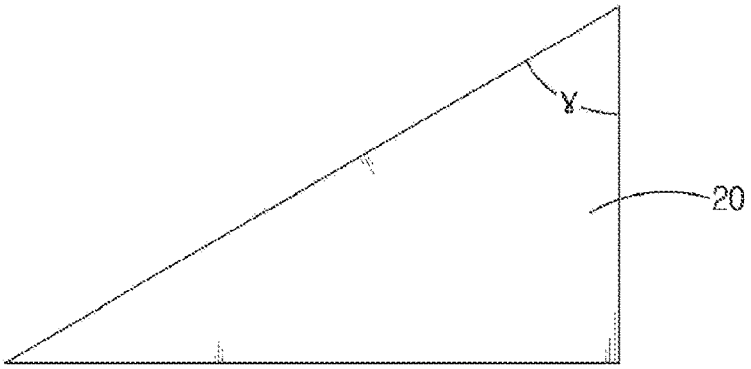
Figure 7A:
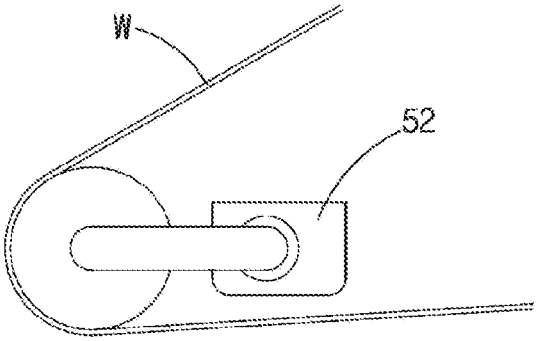
FIGS. 7A, 7B and 7C are diagrams illustrating examples, in which a tension adjusting device shown in FIG. 5 is used.
Figure 7B:
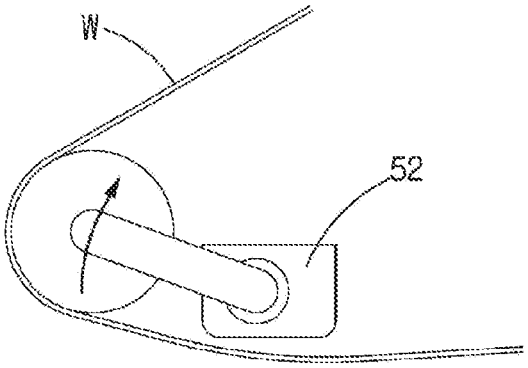
Figure 7C:
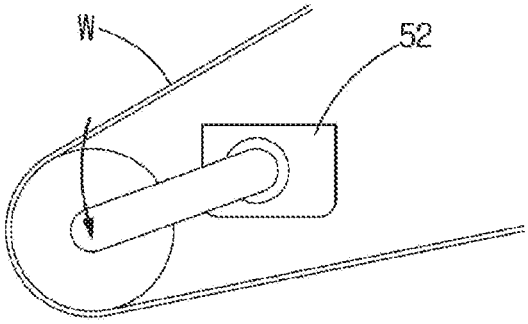

FIG. 1 is a perspective view illustrating an overall shape of a packing system according to some embodiments of the present invention, and FIG. 2 is a perspective view illustrating a guiding device and an endpoint positioning device in the packing system shown in FIG. 1. Here, FIG. 2 illustrates a shape of the packing system of FIG. 1, which is viewed in a direction from a rear side to a front side or from a right side in the drawing to a left side. FIG. 3 is a plan view illustrating a portion, which is a part of the packing system shown in FIG. 1, and in which a guiding device and an endpoint positioning device are provided, and FIG. 4 is a sectional view of FIG. 3. Also, FIG. 5 is a perspective view illustrating a portion, to which a packing material is supplied, of the packing system shown in FIG. 1, FIGS. 6A to 6C are diagrams respectively illustrating an example of an erecting device according to the present invention, and FIGS. 7A to 7C are diagrams illustrating examples, in which a tension adjusting device shown in FIG. 5 is used.

Referring to FIG. 1 and FIGS. 7A to 7C, a packing system 100 according to some embodiments of the present invention is configured to include a transporting device 10, an erecting device 20, a guiding device 30, an endpoint positioning device 40, and a tension adjusting device 50.

The transporting device 10 is an element, which is configured to allow a packing material W, which is placed at a separate position and is wound in a roll shape, and a packing target object O (e.g., a core of a vacuum insulation panel) (hereinafter, "core"), which is transported on the packing material W through a packing-target-object porter 300, to be entered and transported. Since, in the illustrated drawings, a supplying direction of the packing material W is different from a transportation direction of the transporting device 10, the supplying direction of the packing material W is changed by a direction-changing rod 54, but the direction-changing rod 54 may be omitted, depending on an installed location position of the packing system 100. A device, such as a conveyor, of continuously moving/delivering an object may be used as the transporting device 10, and various structures (such as, structures including a driving pulley, a driven pulley, and a belt or including a driving sprocket, a driven sprocket, and a chain) may be used as a connection structure, between a driving part and an axis, for driving of the transporting device 10. However, since this is a conventional structure, a detailed description thereof will be omitted.

The erecting device 20 includes a pair of parts, which are provided near an end portion of the transporting device 10 and are spaced apart from each other, and is configured to allow width-directional both ends of the packing material W entered into the transporting device 10 to be transported in a direction crossing a transportation direction of the packing material W and in a vertically standing manner. The erecting device 20 has a triangular vertical section, and the packing material may be erected to be in contact with an inclined surface of the erecting device. Especially, the erecting device 20 to be used in the present invention is formed to have a rectangular triangle shape, and, as shown in FIGS. 6A to 6C, an angle of an inclined surface (i.e., a slope with respect to a horizontal plane) may be adjusted. In other words, an angle between an inclined surface and a vertical segment of the erecting device 20 may be configured to have an angle $\alpha$ of, for example, about 45°, as shown in FIG. 6A, an angle $\beta$ of, for example, about 30°, as shown in FIG. 6B, and an angle $\gamma$ of, for example, about 60°, as shown in FIG. 6C. That is, the erecting device 20, whose inclined surface is properly inclined according to a thickness or size of the packing material and so forth, may be used.

The guiding device 30 is an element that allows both ends of the packing material W, which are erected by the erecting device 20 and are transported by the transporting device 10, to become close to each other, and that guides the packing material W to be folded and packed in a direction toward a top surface of the core O. For this, the guiding device 30 is configured to include a pair of a first guide body 32 and a second guide body 34, which are spaced apart from each other and face each other, and the first and second guide bodies 32 and 34 are spaced apart from the core O and are placed on the transporting device 10 to be in contact with the packing material W, which is erected by the erecting device 20 and is in motion, thereby providing a space, allowing the packing material W to be folded toward the top surface of the core O. Furthermore, the first and second guide bodies 32 and 34 are configured to have a space D decreasing in a transportation direction of the core O. Here, the guiding device 30 includes a supporter 36 and a guide rail 38, which are configured to be able to adjust the space D between the first and second guide bodies 32 and 34. The supporter 36 may support the first and second guide bodies 32 and 34, thereby allowing them to be positioned on the transporting device 10, and the guide rail 38 is a part, to which the supporter 36 supporting the first and second guide bodies 32 and 34 is coupled. By sliding or moving the supporter 36 in a length direction of the guide rail 38, it may be possible to adjust (e.g., increase or reduce) the space D between the first and second guide bodies 32 and 34 according to the core O (i.e., according to a size or material of the core O).

The endpoint positioning device 40 is an element that is configured to press one and opposite end portions of the packing material W, which face each other and are moved toward each other during passing through the guiding device 30, and to allow the one and opposite end portions of the packing material W to pass therethrough in a direction of the packing material W transported by the transporting device 10. The endpoint positioning device 40 may be called an edge position control (EPC) device and may be configured include a first roller 42, a second roller 44, and a detection part 46. The first roller 42 may include a pair of rollers, which are configured to rotate in opposite directions, with the one end portion of the packing material W interposed therebetween, thereby allowing the packing material W to pass therethrough, and thus, the packing material W is transported in the transportation direction of the transporting device 10. The second roller 44 is configured in the same manner as the first roller 42, but it may be spaced apart from the first roller 42 and may be configured to allow the opposite end portion of the packing material W to pass therethrough. The detection part 46 may sense positions of the one and opposite ends of the packing material W passing through the first and second rollers 42 and 44 and may be used to perform an operation of tightening or loosening the one or opposite end of the packing material W or of increasing or decreasing the pressure from the first or second roller 42 or 44, thereby allowing the one and opposite ends of the packing material W to have the same position (i.e., height). Meanwhile, a speed of the one and opposite end portions of the packing material W, which is moved by the endpoint positioning device 40 (i.e., the first and second rollers 42 and 44), may be preferably equal to the transportation speed of the packing material W and the core O transported by the transporting device 10. Thus, an element, which is configured to adjust rotation speeds of the second roller 44 and the first roller 42 in accordance with transportation speeds of the packing material W and the core O transported by the transporting device 10, may be included in the endpoint positioning device 40.

The tension adjusting device 50 is an element, which is configured to press the packing material W and to adjust tension in the packing material W entered into the transporting device 10, thereby unfolding the packing material W without wrinkle. The tension adjusting device 50 is configured to have one or both of a pressing-position adjusting member 52 and a direction-changing rod 54, and in the present invention, the tension adjusting device 50 is configured to have both of them. The pressing-position adjusting member 52 may be provided in the transporting device 10 and may include a rod-shaped portion that is in contact with the packing material W and crosses the packing material W, thereby allowing the packing material W to be entered into the transporting device 10 in an unfolded state. The pressing-position adjusting member 52 may adjust a position, at which the packing material W is pressed, as shown in FIGS. 7A to 7C, and thus, this may make it possible to adjust the tension. A position of the packing material W pressed by the pressing-position adjusting member 52 may be adaptively adjusted, depending on a usage situation of the packing system 100 (e.g., on sizes and/or materials of the core O and the packing material W), so as to allow the packing material W to have a desired tension. The direction-changing rod 54 is configured to change a direction of the packing material W to be entered into the transporting device 10 and to maintain the packing material W in a flat state when it is entered.

Hereinafter, an operation of a packing system according to some embodiments of the present invention will be described.

Figure 8:
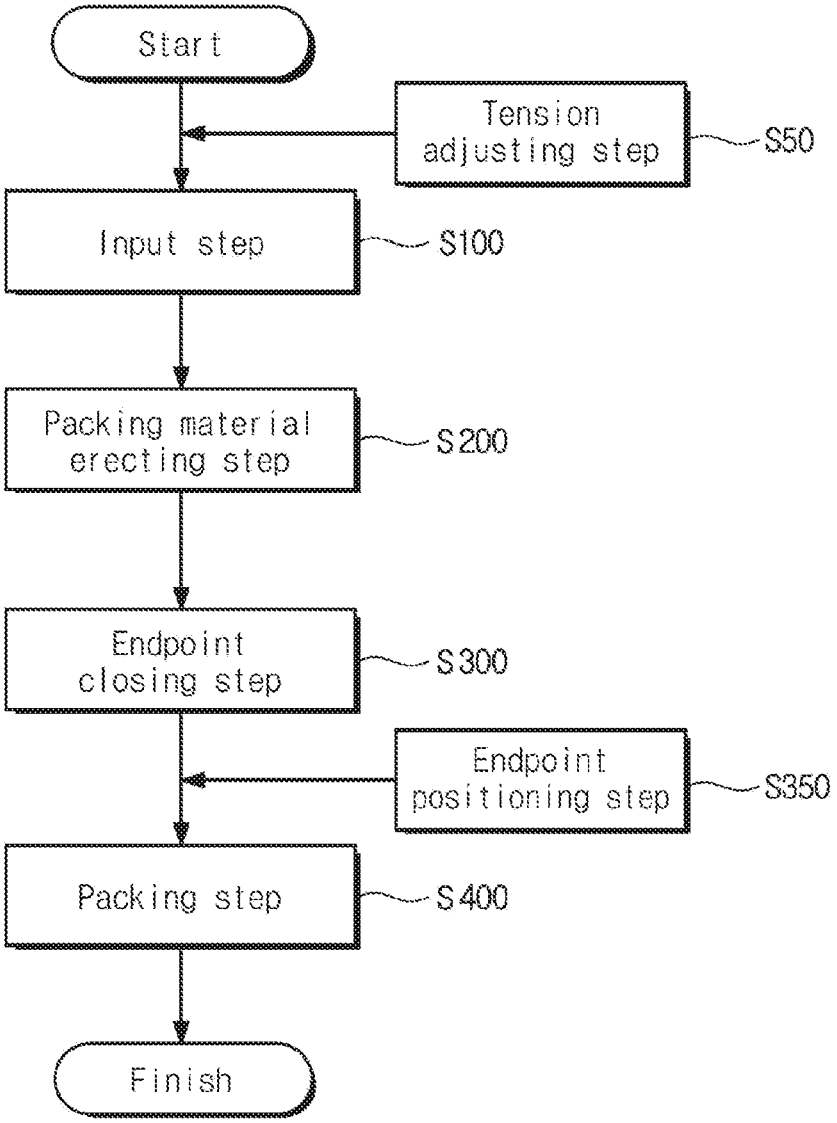
FIG. 8 is a flow chart illustrating an order in a packing process using a packing system according to some embodiments of the present invention.
Figure 9:
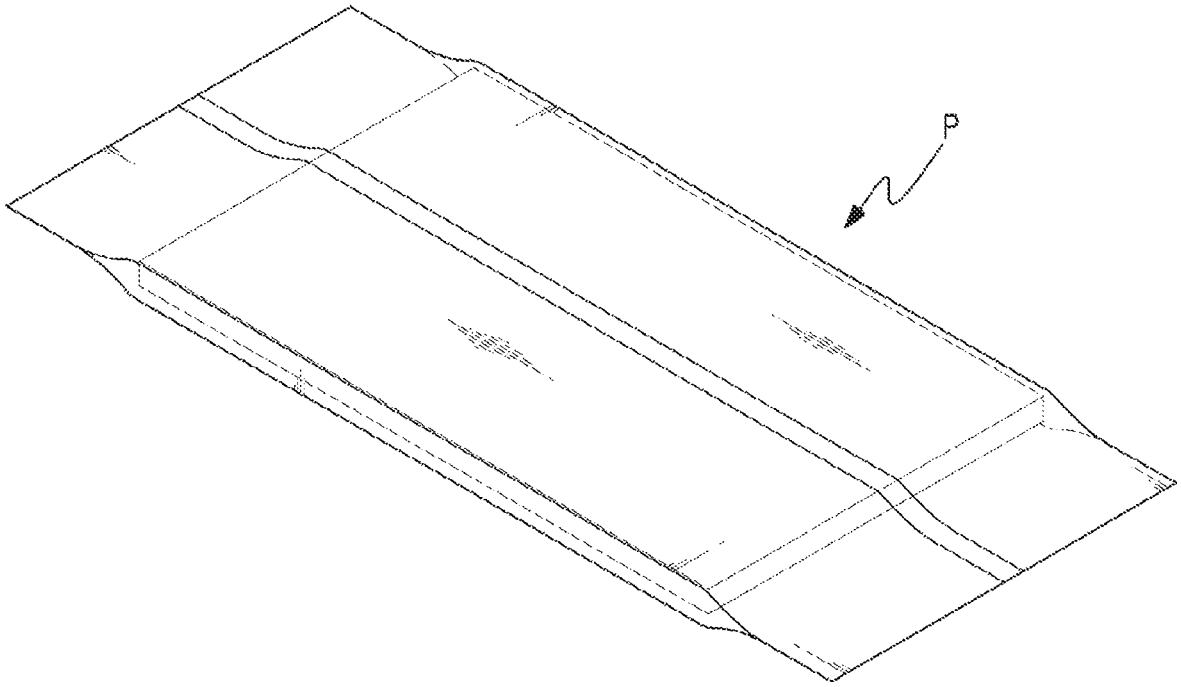
FIG. 9 is a perspective view illustrating an example of a product packed by a packing system according to some embodiments of the present invention.

FIG. 8 is a flow chart illustrating an order in a packing process using a packing system according to some embodiments of the present invention, and FIG. 9 is a perspective view illustrating an example of a product packed by a packing system according to some embodiments of the present invention.

As illustrated in FIG. 8, a packing process using a packing system according to some embodiments of the present invention is performed in the following order: a tension adjusting step S50, an input step S100, a packing material erecting step S200, an endpoint closing step S300, an endpoint positioning step S350, and a packing step S400.

If the operation of the transporting device 10 starts, the packing material W, which is wound in a roll shape, is unwound and moved toward a packing line on the transporting device 10, as shown in FIG. 5. Here, depending on an installed location of the packing system 100, the direction-changing rod 54 may be used to change a direction of the packing material W. The packing material W is unfolded by the tension adjusting device 50 (i.e., the direction-changing rod 54 and the pressing-position adjusting member 52), which is used in the tension adjusting step S50, and is entered into the transporting device 10 in the unfolded state, and the tension adjusting device 50 is used to press the packing material W at a location, where the packing material W is allowed to have a desired tension.

The input step S100 is performed in such a way that the core O is moved using the packing-target-object porter 300 and then is supplied and provided onto a center of the packing material W provided on the transporting device 10. Here, a guide sill (not shown) having a decreasing space in a direction from the packing-target-object porter 300 toward the transporting device 10 may be formed in the packing-target-object porter 300 and may allow the core O to be naturally entered toward the center of the packing material W, when the core O is transferred from the packing-target-object porter 300 to the transporting device 10.

In the packing material erecting step S200, width-directional both ends of the packing material W may be erected, in a direction perpendicularly crossing the transportation direction of the core O, by a pair of erecting devices 20 which are placed at an end of the transporting device 10 and are spaced apart from each other.

Since the erected width-directional both ends of the packing material W are entered in the endpoint positioning device 40 (especially, the first and second rollers 42 and 44) used in the endpoint positioning step S350, and the one and opposite end portions of the packing material W are pressed in such an entered state, the both ends of the packing material W may be maintained to the erected state. In addition to the first and second rollers 42 and 44, an additional element may be used to maintain the both ends of the packing material W to the erected state.

The endpoint closing step S300 may be executed by the guiding device 30. The packing material W, on which the core O is placed, may meet the guiding device 30 (i.e., the first and second guide bodies 32 and 34) during its transportation process. The guiding device 30 may be placed on the transporting device to be spaced apart from the core O, and thus, a portion of the packing material W (i.e., both ends of the packing material W) may be entered into a space between the guiding device 30 and the core O. In this case, the first and second guide bodies 32 and 34 press width-directional both ends of the packing material W against the core O. Thus, the width-directional both ends of the packing material W, which are entered into in spaces formed between the first and second guide bodies 32 and 34 and the core O, may become in contact with bottom and side surfaces of the first and second guide bodies 32 and 34, and as a result, the packing material W may become in close contact with a top surface of the core O. And, the erected both ends of the packing material W may pass through between the first and second guide bodies 32 and 34 in an upward protruding state. Here, since the first and second guide bodies 32 and 34 are configured in such a way that the space D therebetween decreases gradually, the both ends of the packing material W may become close to each other.

Next, in the endpoint positioning step S350, the one and opposite ends of the packing material W may pass through the endpoint positioning device 40 (i.e., the first and second rollers 42 and 44, respectively, each of which includes a pair of rollers configured to rotate in opposite directions), when the both ends of the packing material W are moved toward each other. And, in the detection part 46, positions of the one and opposite ends of the packing material W passing through the first and second rollers 42 and 44 may be sensed using light and so forth. Of course, the detection part 46 may sense the one and opposite ends of the packing material W, which does not yet pass through the first and second rollers 42 and 44, and may sense the one and opposite ends of the packing material W, which passed through the first and second rollers 42 and 44. Also, the detection part 46 may be a single object, which is configured to sense both of the one and opposite ends of the packing material W, and the detection part 46 may be two objects, which are configured to sense the one and opposite ends, respectively, of the packing material W. The detection part 46 is electrically connected to a control device (not shown) controlling the packing system 100 according to some embodiments of the present invention, and information on positions of the one and opposite ends of the packing material W is transferred to the control device.

In the control device, the information on positions of the one and opposite ends of the packing material W, which is transferred from the detection part 46, is analyzed to know whether there is a height difference between the one and opposite ends of the packing material W, and to control operations of the first and second rollers 42 and 44. As a result of the operation of the first roller 42, the positions (i.e., heights) of the one and opposite ends of the packing material W are adjusted to be the same. The adjusting of the positions of the one and opposite ends of the packing material W may be performed using not only the first roller 42 but also the second roller 44. That is, when the one end of the packing material W is higher than the opposite end, the second roller 44, not the first roller 42, may be used to tighten or loosen the opposite end of the packing material W and to adjust the position thereof. It is preferred that determining which one of the first and second rollers 42 and 44 is used for the adjusting of the positions of the one and opposite ends of the packing material W is performed in consideration of positions (heights) of the one and opposite ends of the packing material W passing through the first and second rollers 42 and 44 (i.e., whether a position of the one or opposite end of the packing material W is maintained not to be departed from the first roller 42 or the second roller 44).

The packing step S400 is also performed using the guiding device 30, as in the endpoint closing step S300, and since the first and second guide bodies 32 and 34 are configured in such a way that the space D therebetween decreases gradually, the both ends of the packing material W may become close to each other, and the packing material W may be naturally folded toward the top surface of the core O.

The core O and the packing material W, on which the tension adjusting step S50, the input step S100, the packing material erecting step S200, the endpoint closing step S300, the endpoint positioning step S350, and the packing step S400 have been performed, are ejected in the form of a packed product P shown in FIG. 9, through additional attaching and cutting processes.

Like this, a packing system 100 according to some embodiments of the present invention may reduce the number of a packing process needed to fold the packing material W toward the packing target object O, thereby simplifying the packing process and improving production efficiency, compared with the conventional system. In addition, by using the tension adjusting device 50, it is possible to minimize the wrinkling of the packing material W, and by using the endpoint positioning device 40, it is possible to adjust positions of both ends of the packing material W and thereby to allow the packing material W to be always supplied to a predetermined position, and thus, a failure rate of the packed product P can be reduced. And, since it is possible to adjust a space of the guiding device 30, depending on a size of the packing target object O, the packing target object O with various sizes can be packed using a single system, and in this sense, the invention is useful.

The scope of the present invention is not limited to the embodiments described above but may be realized in various forms of embodiments within the scope of the attached claims. It will be understood by one of ordinary skill in the art that variations in form and detail may be made therein without departing from the spirit and scope of the attached claims.

The invention claimed is:

1. A packing system, comprising:

a transporting device transporting a packing material and a packing target object provided on the packing material;

an erecting device including a pair of parts, which are placed near an end of the transporting device and are spaced apart from each other, the erecting device being configured to allow width-directional both ends of the packing material entered into the transporting device to be transported in a direction perpendicularly crossing a transportation direction of the packing material and in a standing manner; and a guiding device allowing the width-direction both ends of the packing material transported by the transporting device to become close to each other and guiding the packing material to be folded and packed toward a top surface of the packing target object; and an endpoint positioning device that presses one and opposite end portions of the packing material, which are moved toward each other during passing through the guiding device, and that allows the one and opposite end portions of the packing material to pass therethrough in a direction of the packing material transported by the transporting device, wherein the endpoint positioning device comprises:

a pair of first rollers configured to rotate in opposite directions, with the one end portion of the packing material interposed therebetween, thereby allowing the packing material to pass therethrough;

a pair of second rollers configured to rotate in opposite directions, with the opposite end portion of the packing material interposed therebetween, thereby allowing the packing material to pass therethrough; and a detection part configured to sense positions of the one and opposite ends of the packing material passing through the first pair of rollers and the second pair of rollers, thereby allowing the one end or the opposite end of the packing material to be tightened or loosened by the first pair of rollers or the second pair of rollers, and wherein the endpoint positioning device comprises a structure, in which rotation speeds of the first pair of rollers and the second pair of rollers are adjusted depending on a transportation speed of the packing target object transported by the transporting device.

2. The packing system of claim 1, wherein the guiding device is configured to include a pair of a first guide body and a second guide body, which are spaced apart from each other and face each other, the guiding device is spaced apart from the packing target object and is placed on the transporting device to be in contact with the packing material, which is erected by the erecting device and is in motion, thereby providing a space, allowing the packing material to be folded toward the top surface of the packing target object, and a space between the first guide body and the second guide body decreases in the transportation direction of the packing target object.

3. The packing system of claim 2, wherein the guiding device comprises a structure configured to adjust a space between the pair of separate facing the first and second guide bodies depending on one or both of a size and a material of the packing target object.

4. The packing system of claim 1, wherein the erecting device has a triangular vertical section shape, and the packing material is in contact with an inclined surface of the erecting device.

5. The packing system of claim 4, wherein the inclined surface of the erecting device has an adjustable angle with respect to a horizontal plane.

6. The packing system of claim 1, further comprising a tension adjusting device pressing the packing material to be entered into the transporting device.

7. The packing system of claim 6, wherein the tension adjusting device comprises one or more of a pressing-position adjusting member, which is provided in the transporting device and adjusts a pressing position of the packing material, and a direction-changing rod, which changes a direction of the packing material to be entered into the transporting device.

8. A packing method, comprising:

an input step of inputting a packing material and a packing target object placed on the packing material into a transporting device;

a packing material erecting step of transporting the packing material transported by the transporting device in a direction perpendicularly crossing a transportation direction and in a standing manner, using a pair of separated erecting devices provided at an end of the transporting device;

an endpoint closing step of allowing width-directional both ends of the packing material transported by the transporting device to become close to each other through a guiding device;

an endpoint positioning step of pressing one and opposite end portions of the packing material, which are moved toward each other through the endpoint closing step, using an endpoint positioning device, and of passing the one and opposite end portions of the packing material in a direction of the packing material transported by the transporting device; and a packing step of folding and packing the both ends of the packing material toward a top surface of the packing target object, using the guiding device, wherein the endpoint positioning device comprises:

a pair of first rollers configured to rotate in opposite directions, with the one end portion of the packing material interposed therebetween, thereby allowing the packing material to pass therethrough;

a pair of second rollers configured to rotate in opposite directions, with the opposite end portion of the packing material interposed therebetween, thereby allowing the packing material to pass therethrough; and a detection part configured to sense positions of the one and opposite ends of the packing material passing through the first pair of rollers and the second pair of rollers, thereby allowing the one end or the opposite end of the packing material to be tightened or loosened by the first pair of rollers or the second pair of rollers, and wherein the endpoint positioning device comprises a structure, in which rotation speeds of the first pair of rollers and the second pair of rollers are adjusted depending on a transportation speed of the packing target object transported by the transporting device.

9. The method of claim 8, wherein the guiding device is configured to include a pair of a first guide body and a second guide body, which are spaced apart from each other and face each other, the guiding device is spaced apart from the packing target object and is placed on the transporting device to be in contact with the packing material, which is erected by the erecting device and is in motion, thereby providing a space, allowing the packing material to be folded toward the top surface of the packing target object, and a space between the first guide body and the second guide body decreases in the transportation direction of the packing target object.

10. The method of claim 9, wherein the guiding device comprises a structure configured to adjust a space between the pair of separate facing the first and second guide bodies depending on one or both of a size and a material of the packing target object.

11. The method of claim 8, wherein the erecting device has a triangular vertical section shape, and the packing material is in contact with an inclined surface of the erecting device.

12. The method of claim 11, wherein the inclined surface of the erecting device has an adjustable angle with respect to a horizontal plane.

13. The method of claim 8, further comprising a tension adjusting step of adjusting tension of the packing material to be entered into the transporting device, using a tension adjusting device, before the input step.

14. The method of claim 13, wherein the tension adjusting device comprises one or more of a pressing-position adjusting member, which is provided in the transporting device and adjusts a pressing position of the packing material, or a direction-changing rod, which changes a direction of the packing material to be entered into the transporting device.

* * * * *